US011771208B2

(12) United States Patent
Tsanev et al.

(10) Patent No.: US 11,771,208 B2
(45) Date of Patent: Oct. 3, 2023

(54) FRAME FOR HAMMOCK SWING

(71) Applicants: Tihomir Tsanev, Arlington Heights, IL (US); Detelina T. Tsaneva, Ruse (BG)

(72) Inventors: Tihomir Tsanev, Arlington Heights, IL (US); Detelina T. Tsaneva, Ruse (BG)

( * ) Notice: Subject to any disclaimer, the term of this patent is extended or adjusted under 35 U.S.C. 154(b) by 73 days.

(21) Appl. No.: 17/196,817

(22) Filed: Mar. 9, 2021

(65) Prior Publication Data

US 2021/0244161 A1 Aug. 12, 2021

Related U.S. Application Data

(62) Division of application No. 16/592,027, filed on Oct. 3, 2019, now Pat. No. 10,973,307.

(51) Int. Cl.
*A45F 3/24* (2006.01)

(52) U.S. Cl.
CPC ..... *A45F 3/24* (2013.01)

(58) Field of Classification Search
CPC ..... A45F 3/24; A45F 3/26; E05D 11/1007; Y10T 16/54; Y10T 16/54024; Y10T 16/54026; F16B 21/02
See application file for complete search history.

(56) References Cited

U.S. PATENT DOCUMENTS 5,113,537 A * 5/1992 Turk ..... A45F 3/24 5/127
5,636,392 A * 6/1997 Choi ..... A45F 3/24 5/127
6,082,922 A * 7/2000 Cheng ..... A47D 13/063 403/92

FOREIGN PATENT DOCUMENTS

JP 07298923 A * 11/1995

OTHER PUBLICATIONS https://www.youtube.com/watch?v=W7RbAdsc2f8 , Yellow Leaf Hammocks Founders Story, Joe Demin, May 2019 (Year: 2019).*

* cited by examiner

*Primary Examiner* — Robert G Santos
*Assistant Examiner* — Adam C Ortiz
(74) *Attorney, Agent, or Firm* — Technology Law, PLLC

(57) ABSTRACT

A frame for supporting a hammock includes a support member having a first end, a second end, and a midpoint between the first end and second end. The hammock support member defines a first surface portion that extends from the first end to the midpoint and a second surface portion that extends from the midpoint to the second end. The second surface portion is substantially symmetrical with the first surface portion about a plane of symmetry that extends through the midpoint. The first surface portion includes a first segment, a second segment, and a third segment. The second segment is between the first segment and the third segment. The first, second, and third segments are arc shaped. The first segment has a first radius, the second segment has a second radius, and the third segment has a third radius. The second radius is smaller than the first and third radii.

13 Claims, 7 Drawing Sheets

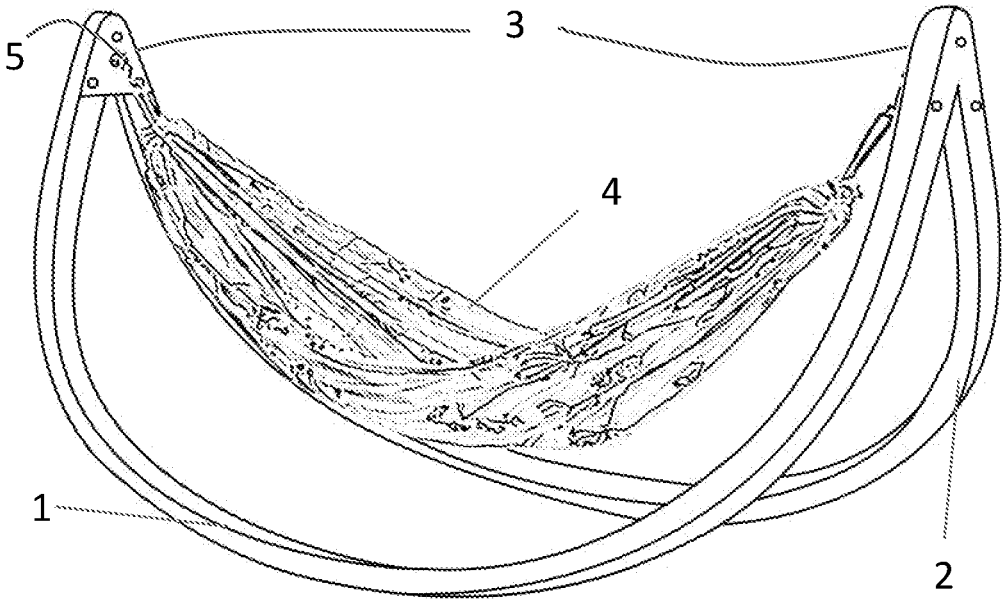
FIG.1
FIG.2
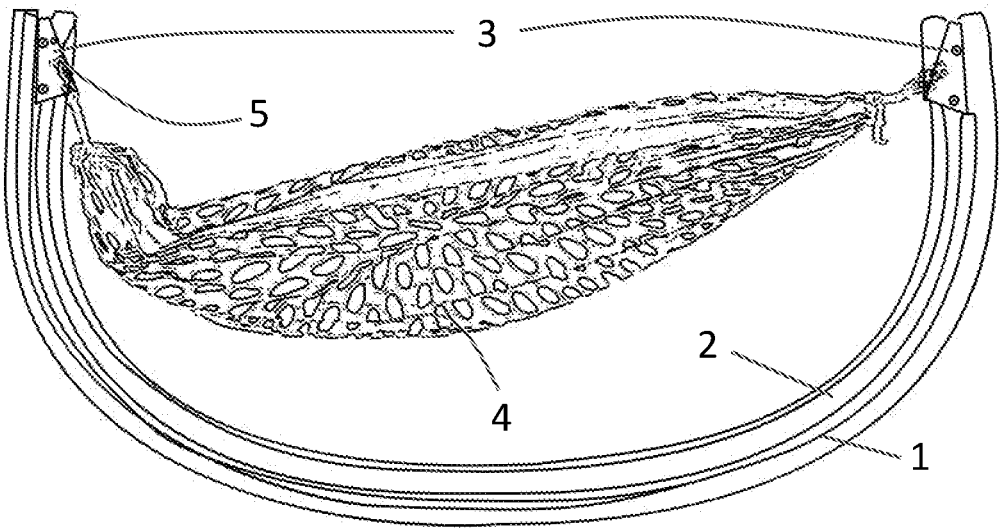

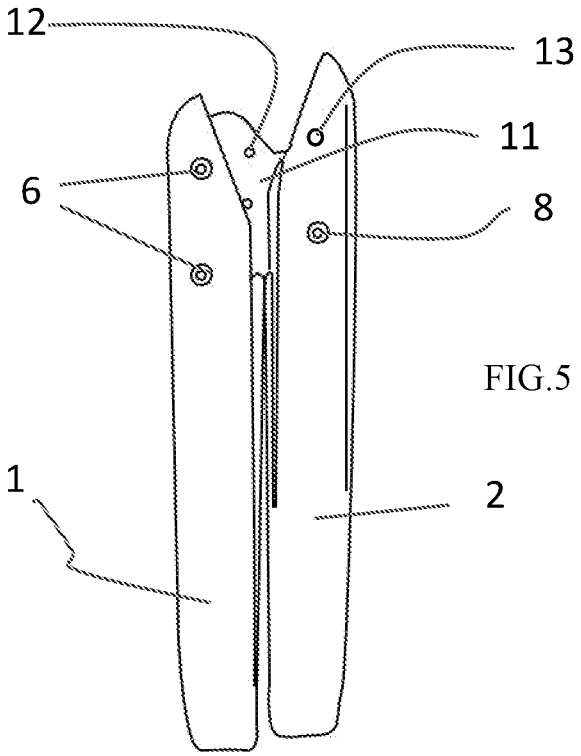
FIG.5
FIG.6
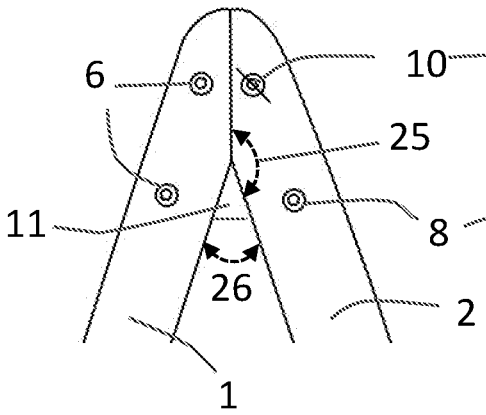
FIG.7
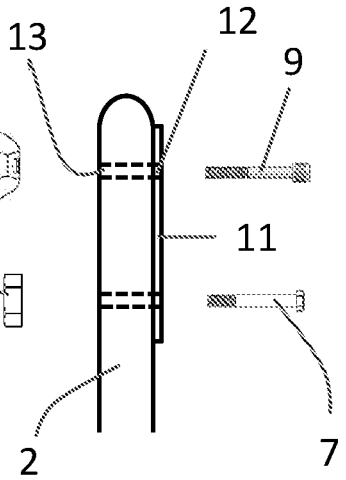

FRAME FOR HAMMOCK SWING

CROSS-REFERENCE TO RELATED APPLICATION

This application is a divisional of U.S. patent application Ser. No. 16/592,027, filed Oct. 3, 2019, and which is hereby incorporated by reference in its entirety.

TECHNICAL FIELD

This disclosure relates to a frame for supporting a hammock.

BACKGROUND

Different hammock supporting frames are known. For example, patent application US2016/0106200 A1 discloses a frame that has two curved elongate support members bolted together at opposite ends under acute angle. Each elongate element is made of several sections and can be taken apart.

Although the prior art has numerous reclining positions that allow the hammock to move back and forth, the circular arc shape of the two elongate support members is such that the frame tends to be hard to balance by the user and too easily leans one way or the other.

While portability may be an important part of the prior art, it is usually achieved by taking apart the hammock frame which is very time consuming and inconvenient for the user. Foldable models (e.g. US337792A) are complicated, costly to manufacture, and heavy or hard and time-consuming to fold by the user.

SUMMARY

A frame for supporting a hammock includes a support member having a first end, a second end, and a midpoint between the first end and second end. The hammock support member defines a first surface portion that extends from the first end to the midpoint and a second surface portion that extends from the midpoint to the second end. The second surface portion is substantially symmetrical with the first surface portion about a plane of symmetry that extends through the midpoint.

The first surface portion includes a first segment, a second segment, and a third segment. The second segment is between the first segment and the third segment. The first, second, and third segments are arc shaped. The first segment has a first radius, the second segment has a second radius, and the third segment has a third radius. The second radius is smaller than the first and third radii.

The hammock frame provided herein improves upon the prior art because the hammock frame is free to rotate to tilted positions dependent upon an occupant's center of gravity relative to the hammock frame wherein the hammock frame will support the occupant in stable reclining and multiple stable sitting positions as well as in multiple stable positions.

The above features and advantages and other features and advantages of the present disclosure are readily apparent from the following detailed description of the best modes for carrying out the disclosure when taken in connection with the accompanying drawings

BRIEF DESCRIPTION OF THE DRAWINGS

FIG. 1 is a three dimensional view of the foldable frame for hammock swing with attached hammock in unfolded position;

FIG. 2 is a three dimensional view of the foldable frame for hammock swing with attached hammock in folded position;

FIG. 5 is an end outside view of the foldable frame for hammock swing and the hinge connecting the two support members in folded position;

FIG. 6 is an outside view of the opened hinge connecting the two support members in opened position;

FIG. 7 is a side view of the hinge connecting the two support members with comprising elements;

DESCRIPTION OF THE PREFERRED EMBODIMENTS

Figure 3:
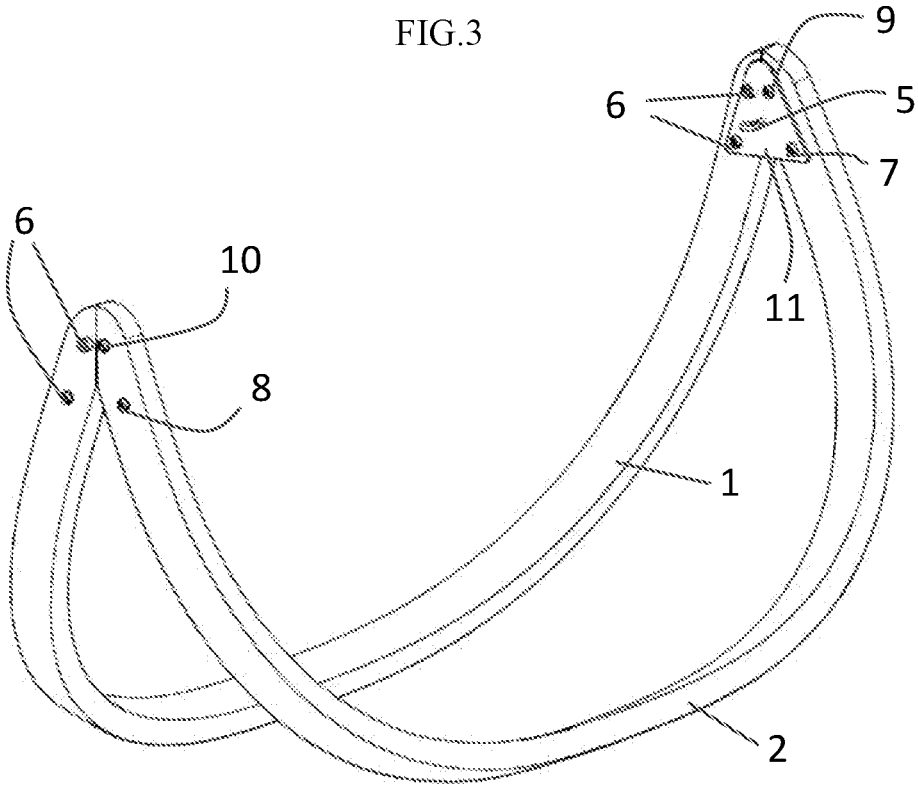
FIG. 3 is a three dimensional view of the assembled frame for hammock swing.
Figure 4:
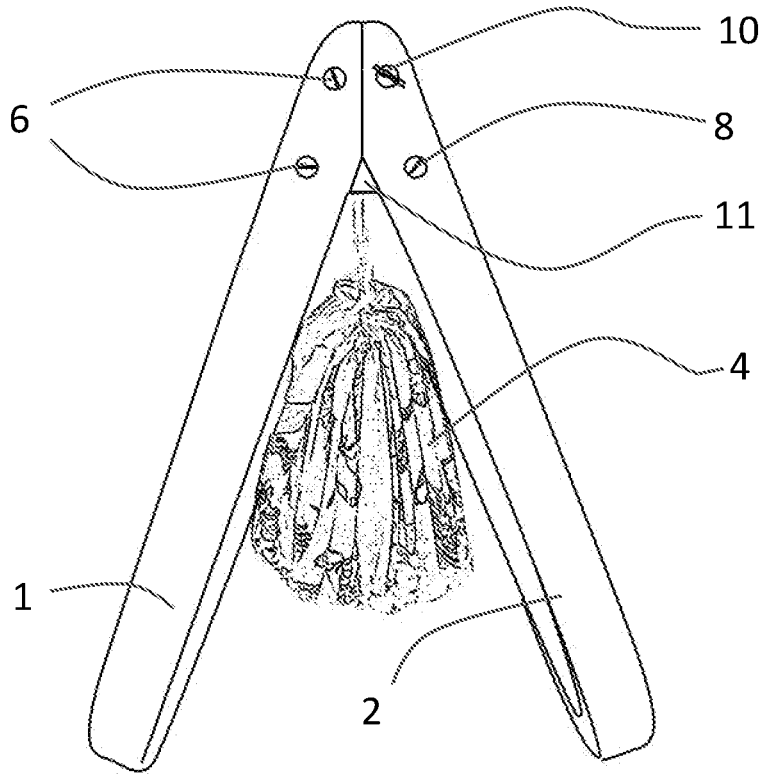
FIG. 4 is an end view of the assembled frame for hammock swing with attached hammock in unfolded position.
Figure 8:
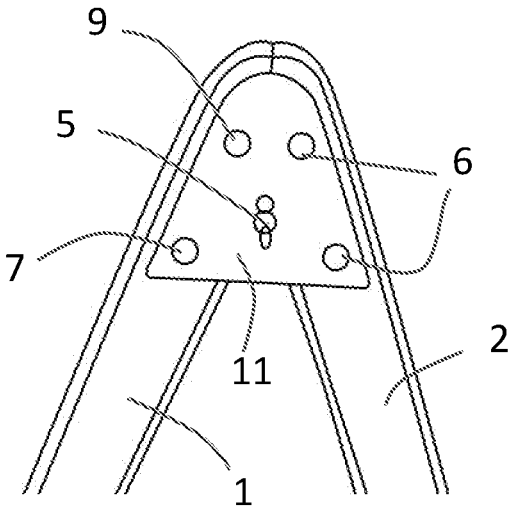
FIG. 8 is an inside view of the hinge connecting the two support members in open position.
Figure 9:
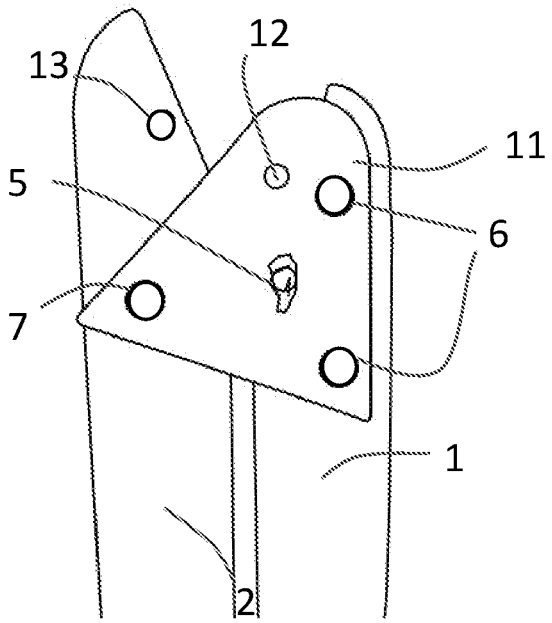
FIG. 9 is an inside view of the hinge connecting the two support members in closed position.
Figure 10:
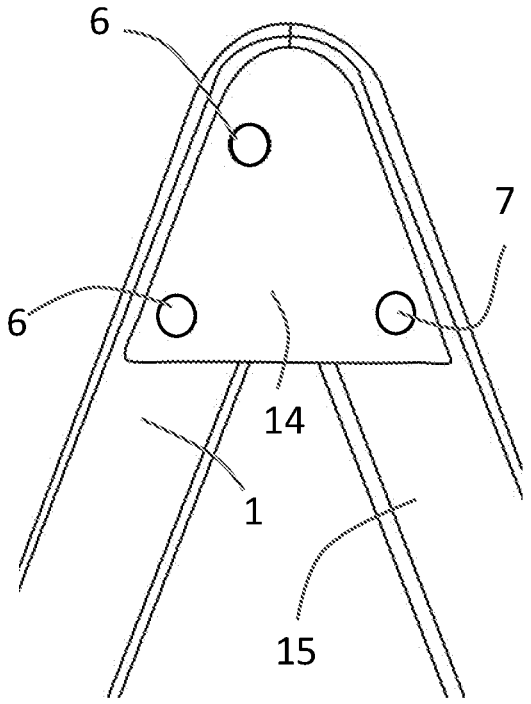
FIG. 10 is an outside view of the hinge connecting the two support members in open position in another embodiment.
Figure 11:
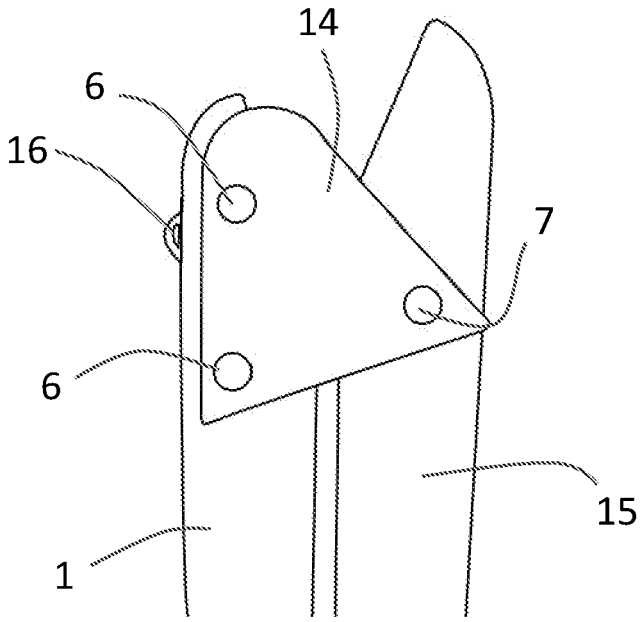
FIG. 11 is an outside view of the hinge connecting the two support members in closed position in another embodiment.

Referring to the Figures, wherein like reference numbers refer to like components throughout, FIG. 1 shows a Foldable frame for hammock swing in unfolded position with attached conventional hammock 4. Said foldable frame for hammock swing comprises two elongate support members 1 and 2, two hinges 3 connecting both ends of the two elongate support members 1 and 2 and two hammock attachment members 5 attached to hinges 3.

In the preferred embodiment elongate support member 1 and elongate support member 2 are identical made of solid wood with rectangular cross-section. In other embodiments, elongate support members 1 and 2 can be made of metal, plastic or other material with ellipse, tubular or other cross sections.

In the preferred embodiment said FFHS has two identical hinges 3. Each hinge 3 (FIG. 5, 6, 7, 8, 9) has a metal plate 11 with four openings, two bolts 6, additional bolt 7 with nut 8, and a fixing mechanism comprising fixing bolt 9 and nut 10. Metal plate 11 is fixed with two bolts 6 to the first elongate support member 1. Said first elongate support member 1 is fixed and cannot be moved in relation to the metal plate 11. The second support member 2 is bolted with bolt 7 and nut 8 to the metal plate 11 and can rotate freely around said bold 7. Thus bolt 7 is a hinge pin working as an axis of rotation for the hinge 3 and allowing the second elongate support member 2 and metal plate 11 to pivot around bolt 7. Thus metal plate 11 and elongate support member 1 can move in relation to elongate support member 2 and the foldable frame for hammock swing can be folded and unfolded.

Part of each hinge 3 is a fixing mechanism comprising bolt 9 and nut 10 used to hold said hinge 3 in open position and thus prevent the foldable frame for hammock swing from folding when in unfolded position.

Other hinge designs can be used to connect the two elongate support members.

Angle limiter limits the hinge opening so that each hinge 3 has a limited rotation angle. Limited rotation angle of the hinge 3 limits the hinge opening and thus allows the FFHS to hold the hammock 4 at a predetermined distance from the ground.

In the preferred embodiment, angle limiter is designed to allow the two elongate support members to diverge at a 40 degrees acute angle 26 (FIG. 6) when the frame is unfolded. In the preferred embodiment, angle limiter is built into each hinge and limits the angle by the shape of both ends of the elongate support members 1 and 2. FIG. 6 show that the end of elongate support member 1 is shaped under (160 degrees) an angle 25. The end of elongate support member 2 is shaped under the same 160 degree angle. Thus when hinge 3 is opened and the foldable frame for hammock swing unfolded, the beveled (under 160 degrees angle) ends of the elongate support members 1 and 2 meet to limit the hinge opening to a 40 degrees angle 26

Other angle limiter designs can be used to limit the hinge angle of rotation. Each elongate support member 1 and 2 is U-sapped and has a curved section comprising ten (10) connected arcs with different curvature profiles (radiuses).

U-shaped elongate support members 1 and 2 allow the foldable frame for hammock swing to stand in multiple reclining positions. In addition, curvature of the U-shaped curve is specially designed to optimize the rocking experience of the user and force the foldable frame for hammock swing to tend to stand centered touching the ground close to mid-point 22 (FIG. 14).

Figure 14:
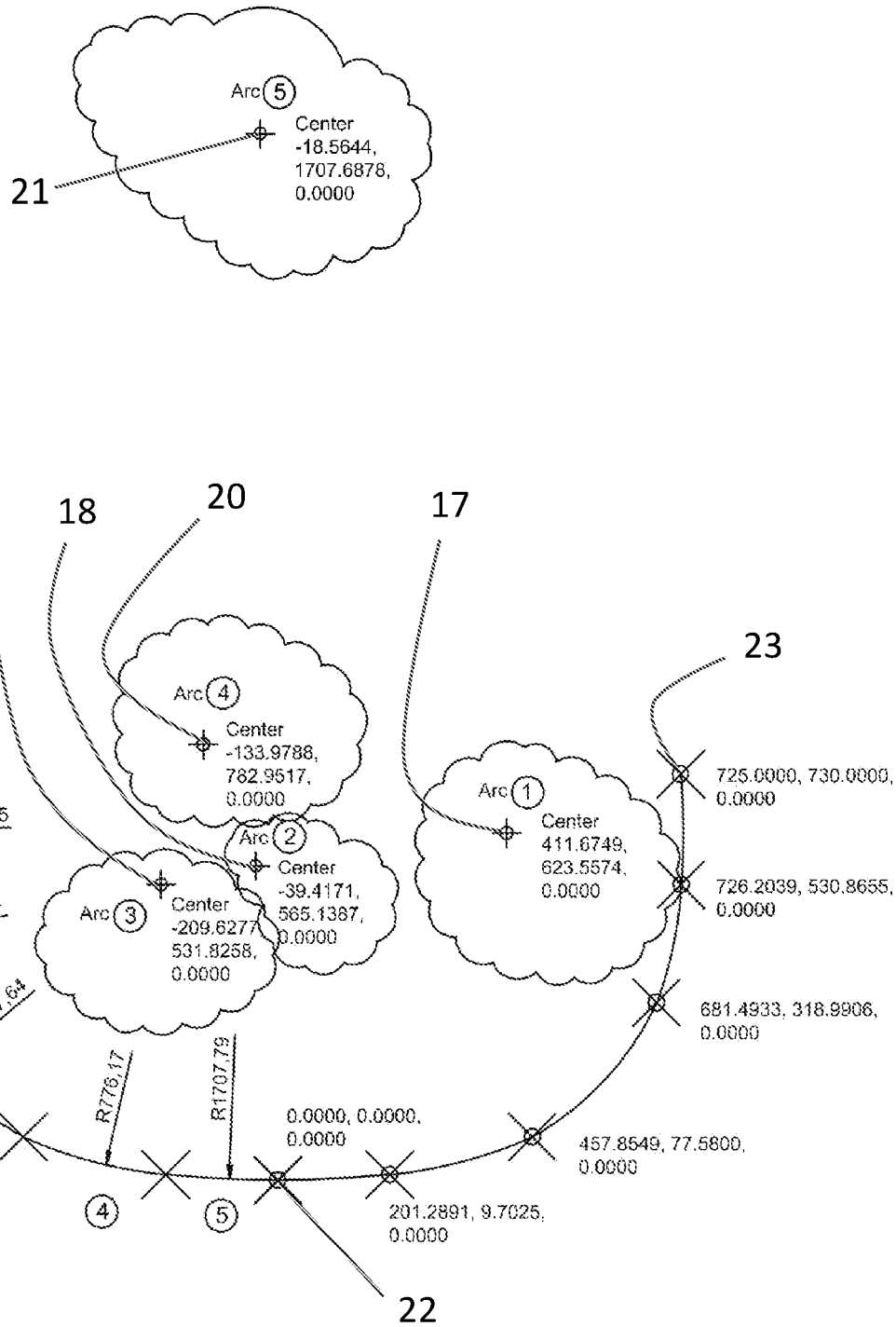
FIG. 14 depicts the curvature of the inside edge of the elongate support member drawn in a coordinate system.

FIG. 14 represents the curvature of the inside edge of the U-shaped elongate support member 1 drawn in a coordinate plane (Cartesian coordinate system). As shown in FIG. 14, the inside edge is a surface configured such that the support member 1 is rockable when the surface contacts the ground. The center of the coordinate plane coincides with the curvature mid-point 22 that has coordinates (0,0). The mid-point 22 is also part of the vertical Y-axis that splits the elongate support member curvature into two identical halves. Each curvature half comprises five connected arcs with different centers and radiuses. First half runs from said mid-pint 22 to end point 23 and comprises of the following five arcs:

The first arc has center 17 with coordinates (411.6749, 623.5574) and radius 1141.65 mm The second arc has center 18 with coordinates (−39.4171, 565.1387) and radius 687.64 mm The third arc has center 19 with coordinates (−209.8277, 531.8258) and radius 517.64 mm The fourth arc has center 20 with coordinates (−133.9768, 782.9517) and radius 776.17 mm The fifth arc has center 21 with coordinates (−18.5644, 707.6878) and radius 1707.79 mm Fixing Mechanism is designed to hold the foldable frame for hammock swing in unfolded position and prevent accidental folding of the foldable frame for hammock swing when in use.

In the preferred embodiment fixing mechanism is part of each hinge 3 and comprises of a fixing bolt 9 (FIG. 7) that is inserted through additional openings 12 in the metal plate 11 and opening 13 in said second elongate support member 2. Nut 10 is used to hold fixing bolt 9 in position. In such unfolded position opening 12 in the metal plate 11 and opening 13 in the elongate support member 2 align and allow the fixing bolt 9 to be inserted holding the frame in open (unfolded) position. When the fixing bolt 9 is inserted in the two aligned openings 12 and 13 the fixing mechanism is engaged and the foldable frame for hammock swing cannot be folded. When said bolt 9 is removed from said aligned openings the fixing mechanism is disengaged and the foldable frame for hammock swing can be folded.

Figure 12:
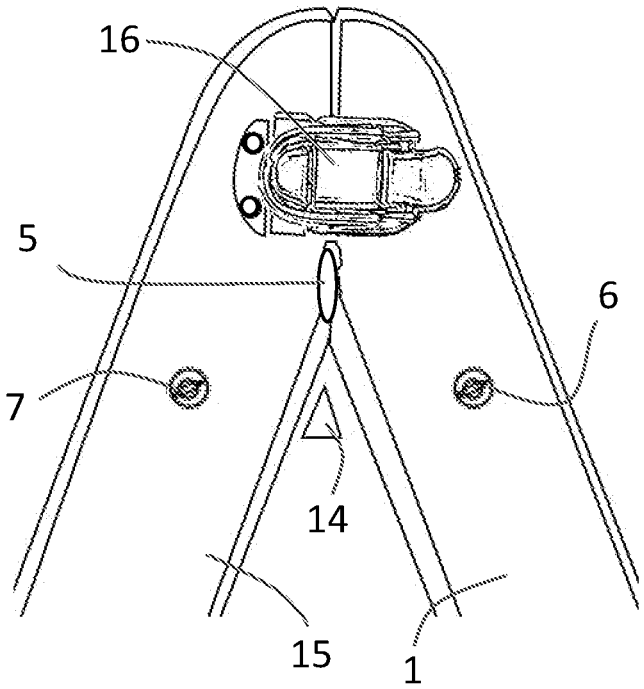
FIG. 12 is an inside view of the hinge connecting the two support members in open position in another embodiment.
Figure 13:
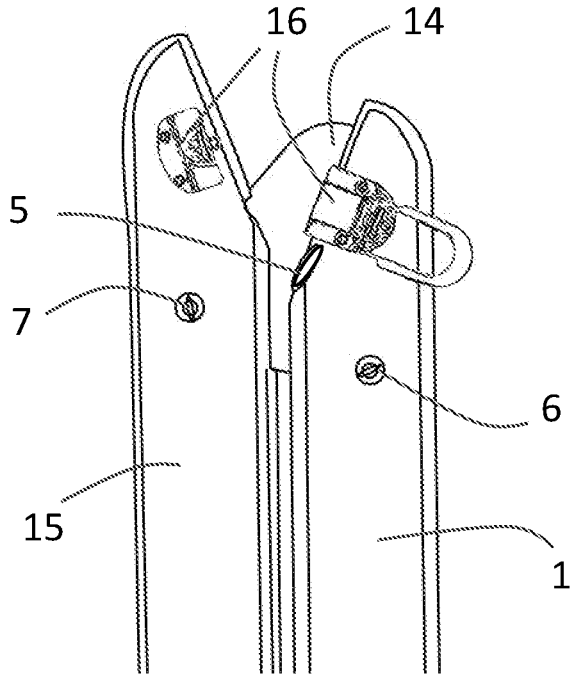
FIG. 13 is an inside view of the hinge connecting the two support members in closed position.

Other fixing mechanism designs can be used to hold the frame in unfolded position. In another embodiment (FIGS. 10, 11, 12 and 13) the fixing mechanism comprises of a two part latch 16 affixed to elongate support member 1 and 15. When the foldable frame for hammock swing is unfolded latch 16 can be engaged (FIG. 12) and thus prevent accidental folding of the FFHS while in use. In this embodiment metal plate 14 has only 3 openings and elongate support member 15 has the same shape as elongate support member 1. Elongate support member 15 has only one opening in each end for bolt 7. Thus bolt 7 is a hinge pin working as an axis of rotation for the hinge 3 and allowing the second elongate support member 15 and metal plate 14 to pivot around bolt 7. Thus metal plate 14 and elongate support member 1 can move in relation to elongate support member 15 and the foldable frame for hammock swing can be folded and unfolded.

In this embodiment Metal plate 14 is positioned on the outer side of elongate support members 1 and 15.

While the best modes for carrying out the invention have been described in detail, those familiar with the art to which this invention relates will recognize various alternative designs and embodiments for practicing the invention within the scope of the appended claims.

The invention claimed is:

1. A hammock frame comprising:

a hammock support member having a first end, a second end, and a midpoint between the first end and the second end;

said hammock support member defining a surface having a first surface portion that extends from the first end to the midpoint;

said surface having a second surface portion that extends from the midpoint to the second end and that is substantially symmetrical with the first surface portion about a plane of symmetry that extends through the midpoint;

said surface being configured such that the hammock support member is rockable when the surface contacts the ground;

said first surface portion having a first segment, a second segment, and a third segment;

said second segment being between the first segment and the third segment;

said first, second, and third segments each being arc shaped;

said first segment having a first radius, said second segment having a second radius, and said third segment having a third radius;

said second radius being no more than 70% of the third radius; and said second radius being no more than 80% of the first radius.

2. The hammock frame of claim 1, wherein the first segment is closer to the first end than the second and third segments; and wherein the first radius is smaller than the third radius.

3. A hammock frame comprising:

a first hammock support member having a first end, a second end, and a midpoint between the first end and the second end;

said first hammock support member defining a surface having a first surface portion that extends from the first end to the midpoint;

said surface having a second surface portion that extends from the midpoint to the second end and that is substantially symmetrical with the first surface portion about a plane of symmetry that extends through the midpoint;

said surface being configured such that the first hammock support member is rockable when the surface contacts the ground;

said first surface portion having a first segment, a second segment, and a third segment;

said second segment being between the first segment and the third segment;

said first, second, and third segments each being arc shaped;

said first segment having a first radius, said second segment having a second radius, and said third segment having a third radius;

said second radius being no more than 70% of the third radius;

said second radius being no more than 80% of the first radius; and a second hammock support member having a third surface portion substantially identical to the first surface portion and a fourth surface portion substantially identical to the second surface portion;

said second hammock support member being connected to the first hammock support member.

4. The hammock frame of claim 3, further comprising a hinge assembly operatively interconnecting the first and second hammock support members such that the first and second hammock support members are selectively rotatable with respect to each other.

5. The hammock frame of claim 4, wherein the hinge assembly includes a plate that is fixed to the first hammock support member such that the plate cannot move relative to the first hammock support member;

wherein the hinge assembly includes a hinge pin that operatively connects the second hammock support member to the plate such that the second hammock support member is selectively rotatable relative to the plate and the first hammock support member.

6. The hammock frame of claim 5, wherein the second hammock support member is rotatable relative to the first hammock support member between a folded position and an unfolded position; and wherein the hinge assembly further includes a fixing mechanism that is configured to selectively prevent the movement of the second hammock support member from the unfolded position.

7. The hammock frame of claim 6, wherein the plate defines a first opening;

wherein the second hammock support member defines a second opening;

wherein the first and second openings align with each other when the second hammock support member is in the unfolded position; and wherein the fixing mechanism is a fixing member that is insertable through the first and second openings.

8. The hammock frame of claim 7, wherein the fixing member is a bolt.

9. The hammock frame of claim 6, wherein the fixing mechanism is a two-part latch.

10. The hammock frame of claim 4, further comprising an angle limiter configured to limit the relative rotation between the first and second hammock support members.

11. The hammock frame of claim 10, wherein the angle limiter includes a first beveled surface on the first hammock support member;

wherein the angle limiter includes a second beveled surface on the second hammock support member; and wherein the first and second beveled surfaces are positioned to contact each other when the second hammock support member is in the unfolded position.

12. A hammock frame comprising:

a hammock support member having a first end, a second end, and a midpoint between the first end and the second end;

said hammock support member defining a surface having first surface portion that extends from the first end to the midpoint;

said surface having a second surface portion that extends from the midpoint to the second end and that is substantially symmetrical with the first surface portion about a plane of symmetry that extends through the midpoint;

said surface being configured such that the hammock support member is rockable when the surface contacts the ground;

said first surface portion having a first segment, a second segment, and a third segment;

said second segment being between the first segment and the third segment;

said first segment being closer to the first end than the second and third segments; and said first, second, and third segments each being arc shaped;

said first segment having a first radius, said second segment having a second radius, and said third segment having a third radius; and said second radius being equal to or less than 50% of the third radius;

said second radius being equal to or less than 60% of the first radius.

13. The hammock frame of claim 12, wherein the first surface portion has a fourth segment between the first and second segments;

wherein the first surface portion has a fifth segment between the second and third segments;

wherein the fourth and fifth segments are arc shaped;

wherein the fourth segment has a fourth radius;

wherein the fifth segment has a fifth radius;

wherein the fourth and fifth radii are larger than the second radius and less than the first radius.

* * * * *